US006834930B2

(12) United States Patent
Steinfield et al.

(10) Patent No.: US 6,834,930 B2
(45) Date of Patent: Dec. 28, 2004

(54) IMAGING DEVICE INCLUDING AN OPTICAL SENSOR

(75) Inventors: Steven W. Steinfield, San Diego, CA (US); Lidia Calvo Garcia, San Diego, CA (US); Patricia A. Hess, Poway, CA (US); Teresa D. Kassen, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 8 days.

(21) Appl. No.: 10/405,729

(22) Filed: Apr. 2, 2003

(65) Prior Publication Data

US 2004/0196317 A1 Oct. 7, 2004

(51) Int. Cl.[7] ..... B41J 2/165; B41J 2/01

(52) U.S. Cl. ..... 347/33; 347/1

(58) Field of Search ..... 347/1, 19, 22, 347/32, 33, 81, 83, 241; 355/53; 324/76.11

(56) References Cited

U.S. PATENT DOCUMENTS

| | | | | |
|---|---|---|---|---|
| 5,204,711 | A | * 4/1993 | Takubo et al. | 355/53 |
| 5,975,674 | A | 11/1999 | Beauchamp et al. | |
| 6,007,173 | A | 12/1999 | DeLouise et al. | |
| 6,164,753 | A | 12/2000 | Maza et al. | |
| 6,234,597 | B1 | 5/2001 | Suzuki et al. | |
| 6,322,192 | B1 | 11/2001 | Walker | |
| 6,447,094 | B1 | 9/2002 | Berg et al. | |
| 6,460,962 | B1 | 10/2002 | Dietl et al. | |

* cited by examiner

*Primary Examiner*—Shih-Wen Hsieh

(57) ABSTRACT

An imaging device includes an optical sensor carried by a print carriage. An optical guide has an input end in optical alignment with a maintenance item and has an output end in optical alignment with a location to which the optical sensor may be moved by the print carriage.

32 Claims, 6 Drawing Sheets

IMAGING DEVICE INCLUDING AN OPTICAL SENSOR

BACKGROUND

Optical sensors within an imaging device, such as printer, may be configured to scan print output and to detect flaws in the print quality. The importance of discovering such flaws is that many applications, adjustments may be made which result in improved future print quality. An example of such an adjustment is a correction that substitutes a working nozzle for a non-working nozzle in an inkjet application.

Additionally, in many cases print quality may be improved by attending to maintenance items in a timely manner, i.e. prior to print quality degradation. Where this priority offsets an associated cost, an imaging device may be designed to include additional sensors which monitor such maintenance items. However, the combined cost of sensors configured to scan print output and detect flaws in print quality and additional sensors configured to scan maintenance items may be excessive.

SUMMARY

An imaging device includes an optical sensor carried by a print carriage. An optical guide has an input end in optical alignment with a maintenance item and has an output end in optical alignment with a location to which the optical sensor may be moved by the print carriage.

BRIEF DESCRIPTION OF THE DRAWINGS

The same reference numbers are used throughout the drawings to reference like features and components.

DETAILED DESCRIPTION

Figure 1:
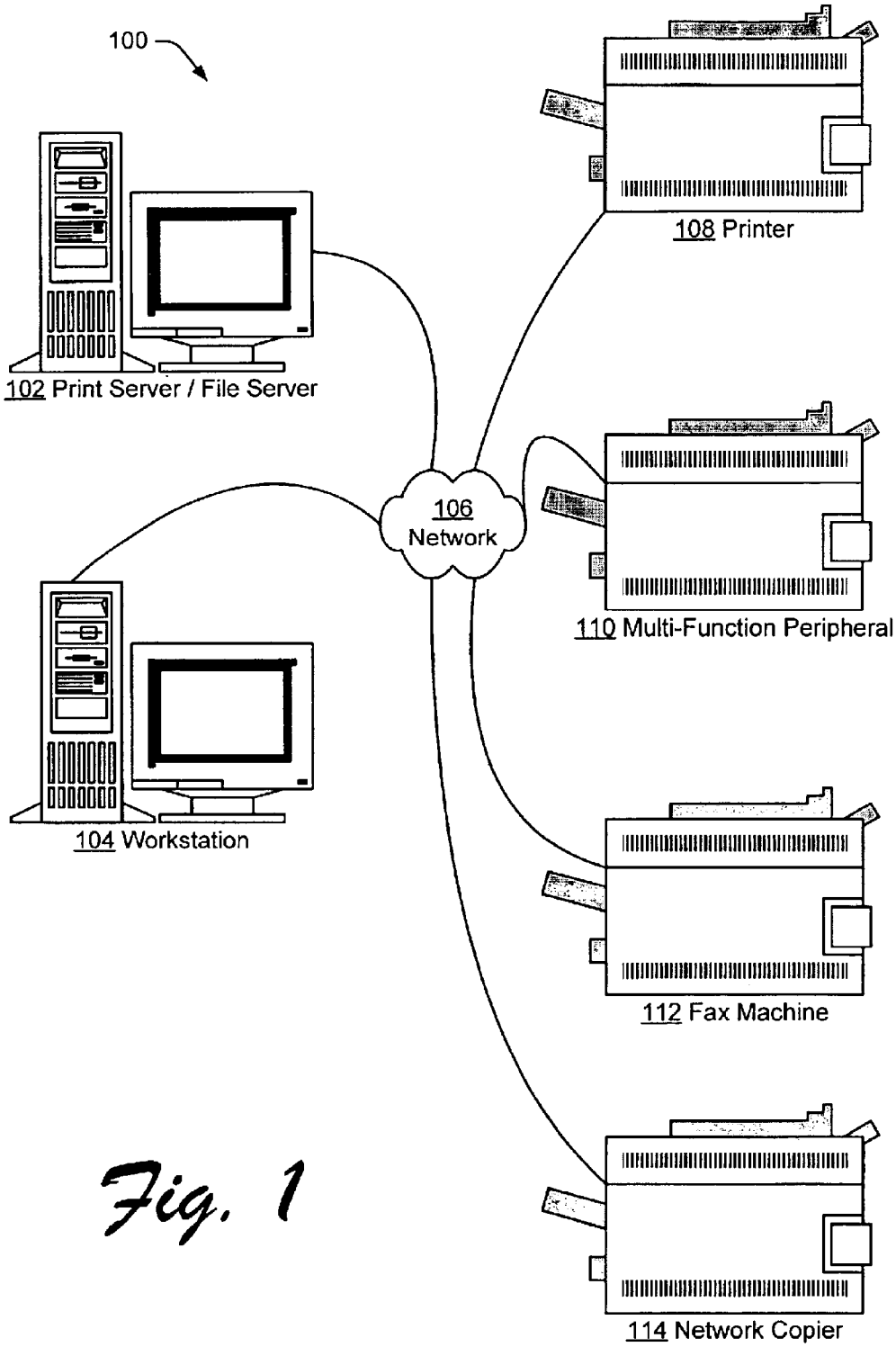
FIG. 1 is an illustration of an exemplary network environment suitable for implementing an embodiment of an optical sensor within an imaging device.

FIG. 1 is an illustration of an exemplary network environment 100 suitable for implementing various embodiments of an optical sensor within an imaging device. A print server 102 and a workstation 104 communicate with imaging devices over a network 106. Imaging devices may include a printer 108, a multi-function peripheral 110, a fax machine 112, a network copier 114 or other device.

Figure 2:
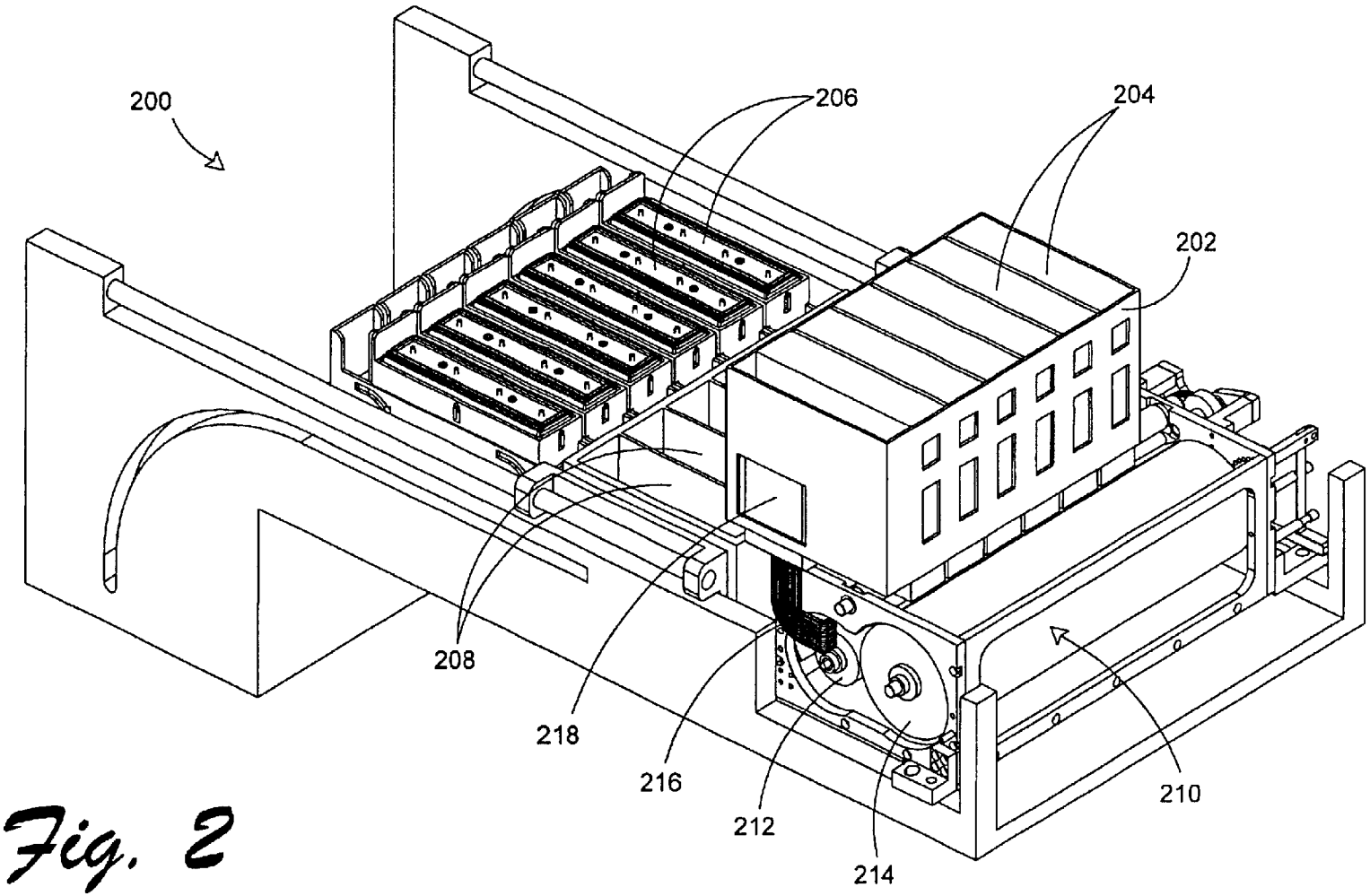
FIG. 2 is an isometric view of an exemplary embodiment of a service station for the maintenance of inkjet print cartridges, showing an exemplary arrangement of an optical sensor and an optical guide in optical alignment with a maintenance item (in this example, a wiper assembly).

FIG. 2 is an isometric view of an embodiment of a service station 200 suitable for use in an imaging device (e.g., any of the imaging devices 108, 110, 112, 114, etc.) wherein the imaging device is based on inkjet technology having a print carriage 202 that includes a plurality of print cartridges 204. The service station 200 includes caps 206 configured for the protection of the print cartridges 204 when not in service. Spittoons 208 provide depositories wherein the print cartridges 204 may discharge ink during a servicing process.

In an exemplary arrangement, an optical guide 216 is in optical alignment with a maintenance item, in this case a wiper assembly 210. The optical alignment between the optical guide 216 and maintenance item does not have to be precisely controlled, provided that information about the maintenance item can pass through the optical guide to the sensor 218. The wiper assembly 210 includes a new wiper material roll 212, containing fresh wiper material, and a used wiper material roll 224, which contains used (i.e. soiled) wiper material. In operation, wiper material is supplied by the new wiper material role 212. The wiper material is used to clean nozzle orifice plates of the print cartridges 204 and is then stored for later removal on the used wiper material roll 214. The input to the optical guide 216 allows the sensor 218, carried by the print carriage 202, to detect a level of remaining new wiper material present in the wiper assembly 210.

Figure 3:
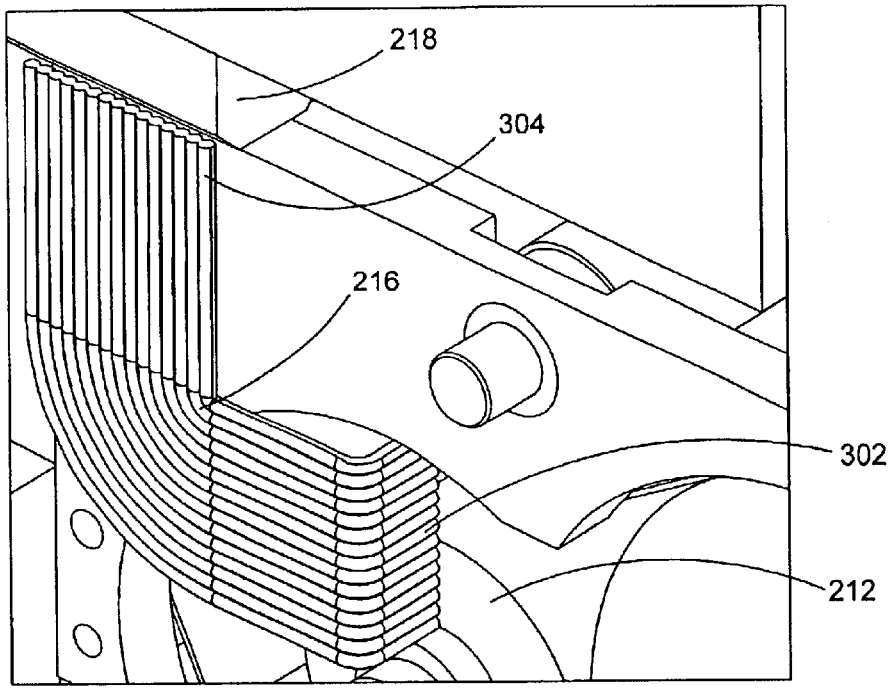
FIG. 3 is an enlarged isometric view of the optical guide of FIG. 2, additionally showing an exemplary implementation of portions of the wiper assembly.

FIG. 3 is an enlarged isometric view of the optical guide 216 of FIG. 2, additionally showing portions of the wiper assembly 210. The optical guide 216 may be made of plastic or other material using waveguide technology (e.g., IR, VIS, UV etc.). An input end 302 of tho optical guide 216 is positioned to obtain optical input on the quantity of remaining wiping material present on the new wiper material roll 212. An output end 304 of the optical guide 216 is positioned in a location which may be scanned by the sensor 218 (or alternative sensor) when the print carriage 202 moves the sensor 218 into optical alignment with the output end of the optical guide.

Figure 4:
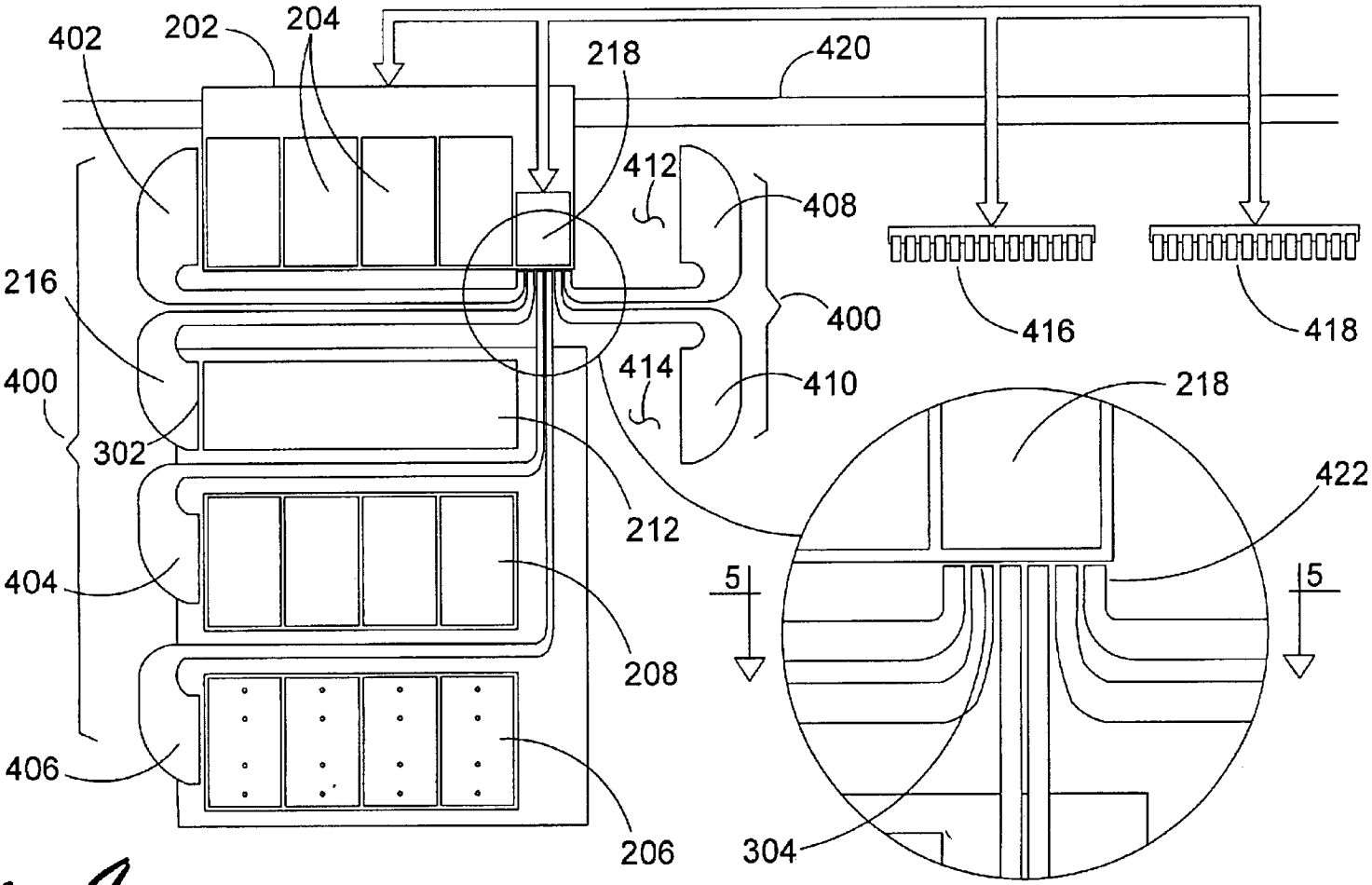
FIG. 4 is an illustrative diagram, not draw to scale, that illustrates an exemplary optical guide cluster configured to observe a plurality of maintenance items within an imaging device.

FIG. 4 is a diagram illustrating portions of an exemplary imaging device (e.g., any of the imaging devices 108, 110, 112, 114, etc.) having an embodiment of an optical guide cluster 400 configured to provide observation of a plurality of maintenance items within the imaging device 108–114. The exemplary optical guide cluster 400 of FIG. 4 includes six optical guides 216, 402, 404, 406, 408, 410. As described above, the optical guide 216 provides information to a sensor 218 about a parameter (e.g., radius, etc.) related to the amount of wiper material remaining in the wiper assembly 210. An input end 302 of the optical guide 216 is in optical communication with the new wiper material roll 212 and an output end 304 is in optical communication with the sensor 218. Similarly, the optical guides 402, 404, 406, 408, 410 provide information to the sensor 218 on the condition of the print cartridges 204; the spittoons 208; the caps 206 for the print cartridges 204; an aerosol reference location 412; and a paper dust contamination reference location 414, respectively.

A processor 416 and an associated memory device 418 control movement of the print carriage 202 over the carriage rod 420, as well as receive input including information from the sensor 218 and information on the position of the print carriage 202. With the print carriage 202 in the position illustrated in FIG. 4, the sensor 218 is able to view the output ends (e.g., the output ends 304 shown in FIG. 3) of the optical guides 216, 402, 404, 408, 410. The alignment of the output ends of two or more optical guides—forming an optical guide cluster 400—results in an optical guide matrix 422.

Figure 5:
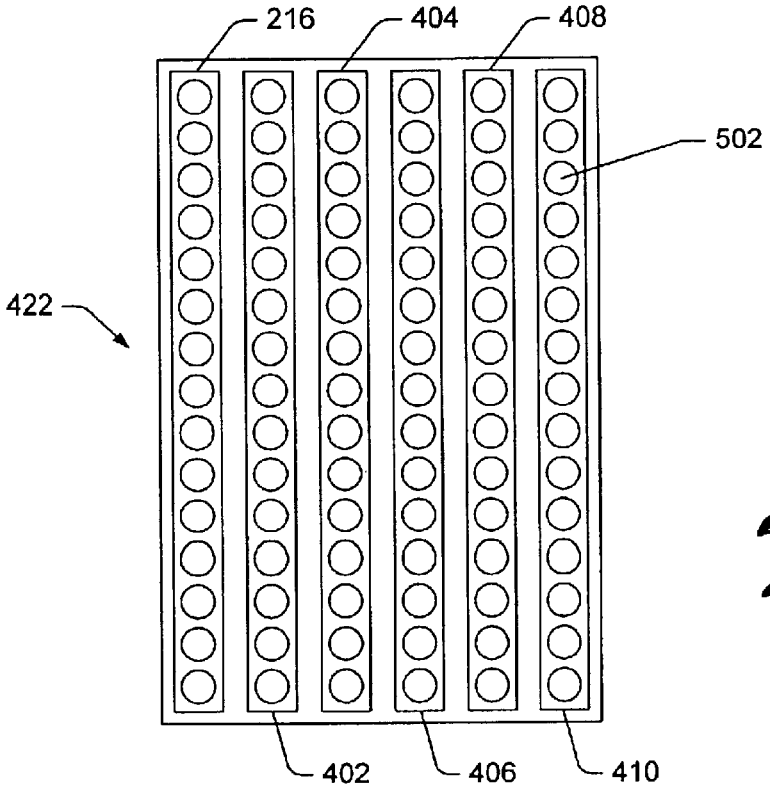
FIG. 5 is a cross-sectional view diagram illustrating an exemplary implementation of an optical guide matrix, taken on the 5—5 lines of FIG. 4.

FIG. 5 is a cross-sectional view diagram illustrating an exemplary optical guide matrix 422, taken on the 5—5 lines of FIG. 4. The optical matrix 422 includes the output ends of the optical guides 216, 402, 404, 408, 410, each having a plurality of transmission pipes 502 (e.g., IR, VIS, UV, etc.).

Figure 6:
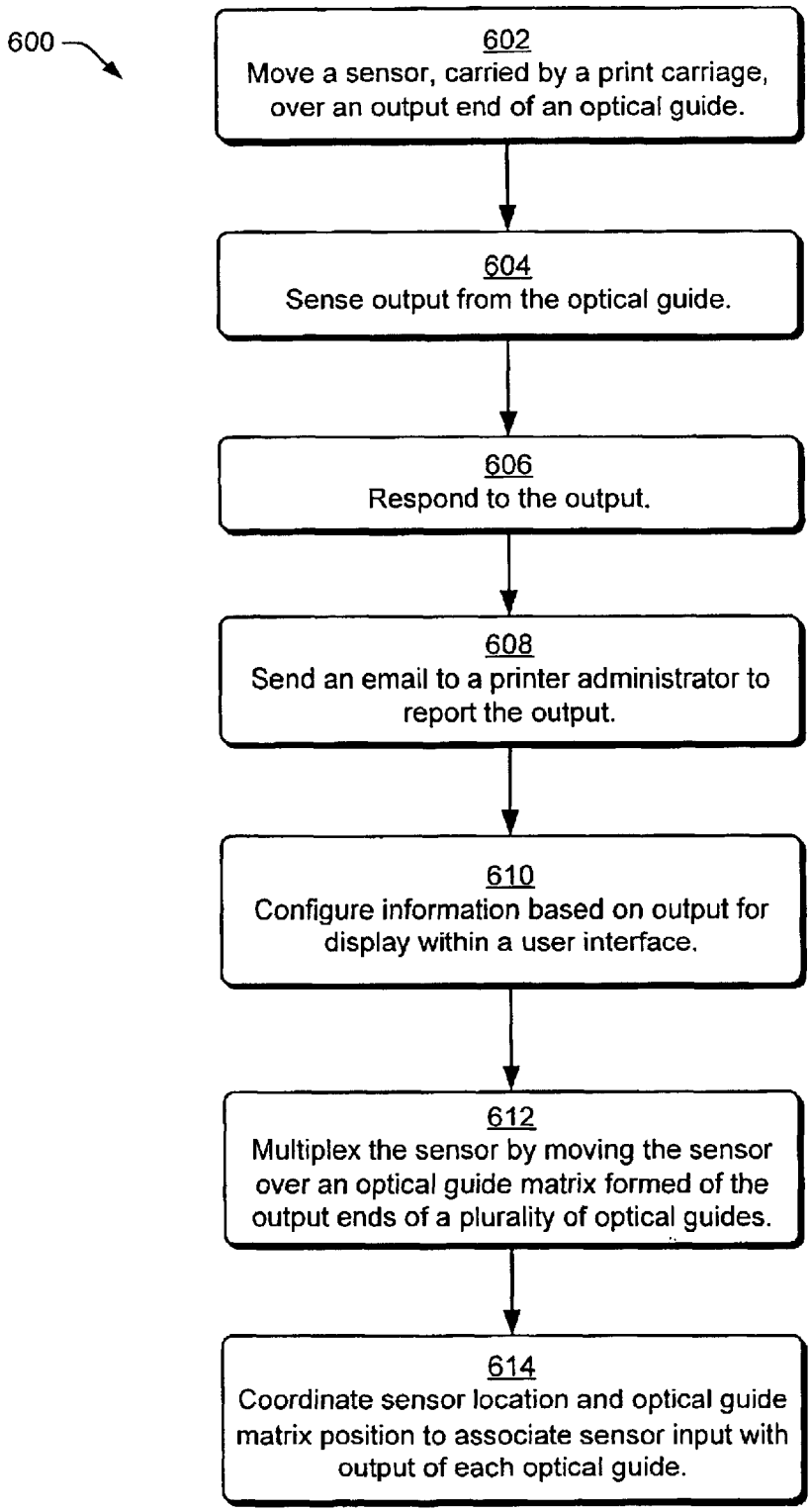
FIG. 6 is a flow diagram that describes an exemplary implementation to enable a carriage-based sensor to perform remote sensing operations.

FIG. 6 is a flow diagram that describes an exemplary implementation 600 to enable a carriage-based sensor to perform remote sensing operations within an imaging device (e.g., any of the imaging devices 108, 110, 112, 114, etc.). The elements of the method may be performed in any desired way, such as by the execution of processor-readable instructions defined on a processor-readable media, such as a disk, a ROM or other memory device. This particular method 600 is described with reference to various components described above and/or illustrated in FIGS. 1–5. Of course, other suitable components may be used to perform this exemplary method and/or other methods described herein.

At block 602, a sensor 218 is carried by a print carriage 202 over an output end 304 of an optical guide 216. At block 604, the sensor 218 detects an image including optical output from the optical guide 216. The image of the optical guide output may include information on the status of remote points of interest. The remote point of interest sensed by the image is known according to sensor location and optical guide location within an optical guide cluster. In particular, the optical guide output may include information on the amount of new wiper material present within the wiper assembly 210, the unused volume remaining for use within the spittoon 208, the ink level remaining within one or more print cartridges 204, the paper dust contamination level of a reference point 414, the status or location of a moving part such as the print cartridge caps 206, or the level of aerosol (frequently air-borne ink particles) contamination building up on a reference surface 412.

At block 606, the imaging device (e.g., 108, 110, 112, 114, etc.) responds to the output detected by the sensor 218. The response may, as seen in block 608, take the form of an email message sent by the imaging device (e.g., 108, 110, 112, 114, etc.) to an administrator. The email message would report the nature of the output, e.g. that paper dust contamination had exceeded a threshold level at a designated reference point, or that the quantity of new wiper material 212 within the wiper assembly 210 had been depleted below a threshold level or depleted at an unacceptable rate. The response may, as seen in block 610, take the form of information configured for display on a user interface, e.g. a light on the enclosure of the imaging device may flash, indicating the situation.

At block 612, the sensor 218 may be multiplexed by moving it over an optical guide matrix 422 formed of the output ends of a plurality of optical guides 216, 402, 404, 406, 408, 410. At block 614, the location of the sensor 218 and the optical guide matrix position are coordinated, thereby associating the sensor input with the output of each optical guide. Accordingly, because the location of the sensor 218 is known at the time input is received from each optical guide, the particular optical guide supplying the input can be determined.

Figure 7:
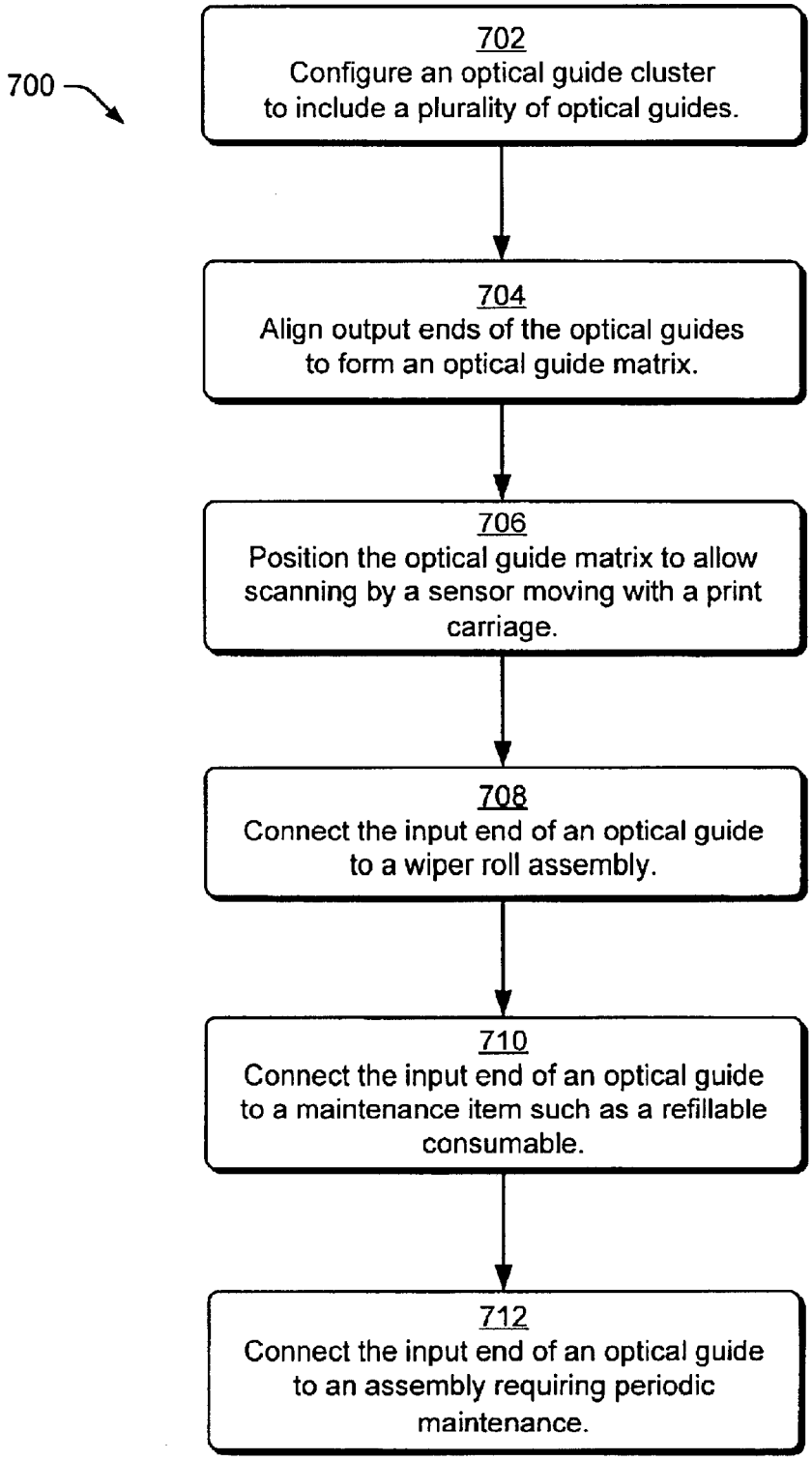
FIG. 7 is a flow diagram that describes an exemplary implementation to configure an optical sensor within an imaging device.

FIG. 7 is a flow diagram that describes an exemplary method 700 to configure an optical sensor within an imaging device. The elements of the method may be performed in any desired way, such as by manual manipulation of components, automated mechanical movement, or by the execution of processor-readable instructions defined on a processor-readable media, such as a disk, a ROM or other memory device in the course of automated manufacturing methods.

At block 702, an optical guide cluster 400 may be configured to include a plurality of optical guides 216, 402, 404, 406, 408, 410. A number of optical guides may be selected according to a number of remote points of interest. Examples of such remote points of interest include: maintenance items including the amount of new material within a wiper assembly 210; the degree to which aerosol contamination has built up on a reference surface 412; the fill-state of a spittoon 208; the status of a moving part taken from an observation point (e.g. caps 206 of cartridge 204); an ink level within a print cartridge 204; or the dust contamination built up on a reference surface 414.

At block 704, the output ends of the optical guides 216, 402, 404, 406, 408, 410 are aligned to form an optical guide matrix 422. At block 706, the optical guide matrix is positioned to allow scanning by a sensor 218 moving with a print carriage 202.

At block 708, the input end of one optical guide 216 may be connected to the wiper roll assembly 210. At block 710, the input end of additional optical guides may be attached to maintenance items, such as refillable consumables (e.g. the ink contained in print cartridges 204). At block 712, the input end of additional optical guides may be attached to items that require locating, maintenance, cleaning or emptying (e.g. the spittoons 208; the caps 206 for the print cartridges 204; an aerosol reference surface 412; and a paper dust contamination reference location 414).

Although the disclosure has been described in language specific to structural features and/or methodological steps, it is to be understood that the appended claims are not limited to the specific features or steps described. Rather, the specific features and steps are exemplary forms of implementing this disclosure. For example, while actions described in blocks of the flow diagrams may be performed in parallel with actions described in other blocks, the actions may occur in an alternate order, or may be distributed in a manner which associates actions with more than one other block.

Additionally, while one or more methods have been disclosed using flow charts and text associated with the blocks, it is to be understood that the blocks do not necessarily have to be performed in the order in which they were presented, and that an alternative order may result in similar advantages.

What is claimed is:

1. An imaging device, comprising:

an optical sensor, carried by a print carriage;

an optical guide, having an input end in optical alignment with a maintenance item and having an output end in optical alignment with a location to which the optical sensor may be moved by the print carriage.

2. The imaging device of claim 1, wherein the maintenance item is a wiper roll.

3. The imaging device of claim 1, wherein the maintenance item is a print cartridge.

4. The imaging device of claim 1, wherein the maintenance item is an aerosol reference location.

5. The imaging device of claim 1, wherein the maintenance item is a spittoon.

6. The imaging device of claim 1, additionally comprising:

an optical guide cluster within which the optical guide is configured; and an optical guide matrix configured from output ends of optical guides forming the optical guide cluster.

7. A processor-readable medium comprising processor-executable instructions for:

moving a sensor, carried by a print carnage, over an output end of an optical guide;

sensing output from the optical guide;

responding to the output.

8. A processor-readable medium as recited in claim 7, wherein the responding comprising further instructions for:

sending an email to an administrator to report the output.

9. A processor-readable medium as recited in claim 7, wherein the responding comprising further instructions for:

configuring information associated with the output for display within a user interface.

10. A processor-readable medium as recited in claim 7, additionally comprising further instructions for:

multiplexing the sensor by moving the sensor over an optical guide matrix comprising output ends of a plurality of optical guides.

11. A processor-readable medium as recited in claim 10, wherein the multiplexing comprises further instructions for:

coordinating sensor location and optical guide matrix position to associate sensor input with output of each optical guide.

12. A method of enabling a carriage-based sensor to perform remote sensing operations, comprising:

configuring an optical guide cluster to include a plurality of optical guides, wherein an input end of each optical guide is configured to respond to remote input information;

aligning output ends of the plurality of optical guides to form an optical guide matrix; and positioning the optical guide matrix adjacent to a carnage rod to allow scanning of the optical guide matrix by a sensor moving with a print carriage.

13. The method of claim 12, additionally comprising:

positioning the input end of at least one optical guide adjacent to a wiper roll assembly.

14. The method of claim 12, additionally comprising:

positioning the input end of at least one optical guide adjacent to a refillable consumable.

15. The method of claim 12, additionally comprising:

positioning the input end of at least one optical guide adjacent to an assembly requiring periodic maintenance.

16. An optical guide cluster, comprising:

a plurality of optical guides;

an optical guide matrix comprising output ends of the plurality of optical guides; and a sensor, movable to allow viewing of the optical guide matrix; and a service station, configured to support the optical guide matrix to allow the sensor to view the optical guide matrix during print cartridge servicing.

17. The optical guide cluster of claim 16, wherein input ends of each of the plurality of optical guides are distributed among remote points of interest.

18. The optical guide cluster of claim 17, wherein the remote points of interest are selected from a group comprising:

a wiper roll;

an aerosol contamination reference surface;

a spittoon fill-state observation point;

a moving part observation point;

an ink level observation point; and a paper dust contamination reference location.

19. An imaging device, comprising:

means for moving a sensor over an output end of an optical guide;

means for sensing output from the optical guide;

means for responding to the output.

20. The imaging device as recited in claim 19, wherein the means for responding additionally comprises:

means for sending an email to report the output.

21. The imaging device as recited in claim 19, wherein the means for responding additionally comprises:

means for sending the output to a user interface for display.

22. The imaging device as recited in claim 19, additionally comprising;

means for multiplexing the sensor by supporting the sensor on a print carriage and by moving the print carriage over an optical guide matrix comprising output ends of a plurality of optical guides.

23. The imaging device as recited in claim 22, additionally comprising:

means for coordinating sensor location and optical guide matrix position to associate sensor input with output of each optical guide.

24. An imaging device, comprising:

an optical sensor, carried by a print carriage for operation within a print path;

an optical guide cluster comprising a plurality of optical guides, each optical guide having an input end in optical alignment with a remote object and having an output end configured within an optical guide matrix; and a processing device to obtain images transferred through the optical guide matrix from the optical sensor, and to associate the images with remote objects according to optical sensor location, and to ascertain remote object status using the images.

25. The imaging claim 24, wherein the optical sensor is configured for alternating between print quality examination and remote object observation.

26. The imaging device of claim 24, wherein the optical sensor is configured for multiplexing each of the plurality of optical guides by controlled movement of the print carriage.

27. A processor-readable medium comprising processor-executable instructions for:

multiplexing a sensor by shifting input to the sensor from among different locations within an optical guide matrix, wherein the optical guide matrix comprises output ends of a plurality of optical guides;

associating images obtained by the sensor with remote objects according to sensor location and optical guide location within an optical guide cluster;

requesting servicing in response to an image.

28. A processor-readable medium as recited in claim 27, wherein thy multiplexing comprises further instructions for:

moving the sensor with respect to the optical guide matrix.

29. A processor-readable medium as recited in claim 27, wherein the requesting servicing comprises further instructions for:

sending an email to an administrator.

30. An imaging device, comprising:

means for multiplexing a sensor by shifting input to the sensor from among different locations within an optical guide matrix, wherein the optical guide matrix comprises output ends of a plurality of optical guides;

means for associating images obtained by the sensor with remote objects according to sensor location and optical guide location within an optical guide cluster;

means for requesting servicing in response to the images.

31. The imaging device as recited in claim 30, wherein the means for multiplexing comprises:

means for moving the sensor with respect to the optical guide matrix.

32. The imaging device as recited in claim 30, wherein the means for requesting servicing comprises:

means for sending information to a user interface.

* * * * *